United States Patent [19]

Krieg et al.

[11] 4,249,102

[45] Feb. 3, 1981

[54] HALOGEN-METAL VAPOR DISCHARGE LAMP

[75] Inventors: Rudolf Krieg, Munich; Alexander Dobrusskin, Taufkirchen; Horst Krense, Ottobrunn, all of Fed. Rep. of Germany

[73] Assignee: Patent-Treuhand-Gesellschaft für elektrische Gluehlampen mbH, Munich, Fed. Rep. of Germany

[21] Appl. No.: 956,343

[22] Filed: Oct. 31, 1978

Related U.S. Application Data

[63] Continuation-in-part of Ser. No. 788,363, Apr. 18, 1977, abandoned.

[30] Foreign Application Priority Data

May 4, 1976 [DE] Fed. Rep. of Germany ..... 2619674

[51] Int. Cl.³ ..... H01J 61/18

[52] U.S. Cl. ..... 313/116; 313/220; 313/229

[58] Field of Search ..... 313/116, 220, 229

[56] References Cited

U.S. PATENT DOCUMENTS

| | | | |
|---|---|---|---|
| 3,384,771 | 5/1968 | Pomfrett | 313/116 |
| 4,041,344 | 8/1977 | LaGiusa | 313/116 X |

*Primary Examiner*—Rudolph V. Rolinec
*Assistant Examiner*—Darwin R. Hostetter
*Attorney, Agent, or Firm*—Frishauf, Holtz, Goodman & Woodward

[57] ABSTRACT

To increase operating temperature, and hence vapor pressure, the arc tube close to the arc, typically an inner arc tube, is at least partially frosted. The outer bulb which surrounds the inner arc tube may also be frosted. The lamps have low color temperature and good color rendering index at high luminous output. The fill preferably includes metal halides of rare earth metals, and/or mercury. The outer bulb is preferably in the form of a reflector bulb.

23 Claims, 2 Drawing Figures

HALOGEN-METAL VAPOR DISCHARGE LAMP

The present application is a continuation-in-part of U.S. application Ser. No. 788,363, filed Apr. 18, 1977, now abandoned.

FIELD OF THE INVENTION

This invention relates to halogen-metal vapor discharge lamps, the arc tube of which is enclosed within an outer bulb, which have light output of low color temperature. The arc tubes of halogen-metal vapor discharge tubes in most cases contain mercury together with metal halides, such as iodides and bromides of the metals sodium, indium, thallium, iron, rare earth metals, and others.

BACKGROUND AND PRIOR ART

It is known to frost the outer surface of the arc tube of high pressure discharge lamps which are filled only with mercury partly or even entirely, for instance, by sandblasting with quartz sand. The purpose of frosting is to attain diffusion to provide a larger beam spread (see German Pat. No. 950,224, page 2, lines 84 and 85 and page 1, lines 5–12) or to render the arc which is contracted in operation, visually sufficiently broad so that the dark space between the arc and the tube wall is brightened and the electrodes are no longer discernible (see U.S. Pat. No. 3,384,771, claim 1, column 4, lines 2–5; column 3, lines 19–21; and column 2, lines 30–32).

THE INVENTION

It is an object to provide a halogen-metal vapor discharge lamp of high luminous output and efficiency with good color rendering, and especially light of low color temperature.

SUMMARY OF THE INVENTION

The halogen-metal vapor discharge lamp according to the present invention contains an arc tube which is enclosed within an evacuated outer bulb, either is frosted only in the cooler spots, or across its entire outer surface. The arc tube close to the arc is roughened. The fill of the lamp is a metal halide, preferably a combination of at least mercury and/or a rare earth metal, present in such quantity in the arc tube that, under operating conditions, the vapor is preferably saturated or just about saturated. A lamp of equal parameters, but with a smooth or an unfrosted, or clear arc tube would have an excess of metal halide.

In operation of the arc tube of the present invention, a portion of the radiation emitted by the discharge is repeatedly reflected by the frosting and, consequently, is absorbed by the tube wall to a higher degree than in the case of an unfrosted arc tube. This absorption raises the temperature of the arc tube. The vapor pressure of the fill is therefore increased and, depending on the quantity of fill material which, as mentioned above, is increased above a lamp with a clear arc tube, operation of the discharge takes place in still saturated condition or in an almost saturated condition.

The temperature increase of a lamp in which the fill is in a saturated condition results in a rise in the vapor pressure with a concurrent increase in the particle density, and thus an enhancement in luminous output and efficiency. With high pressure mercury vapor discharge lamps containing no additives, the rise in temperature of the tube wall would also lead to an increase in vapor pressure, but an increase in density would not be attained and, consequently, no enhancement of luminous efficacy. With the lamps according to the present invention, there is an enhanced luminous efficacy. Most importantly, the light output is of a reduced color temperature, resulting in improved color rendering of the light, which results from the changed conditions of excitation. The frosting in known high pressure mercury vapor discharge lamps does not have the effect of the type with which the present invention is concerned.

The frosting of the arc tube is of particular advantage in halogen-metal vapor discharge lamps containing rare earth metal halides, because it is highly desirable to increase the vapor pressure of said halides which have a relatively low vapor pressure. Due to the higher particle density resulting therefrom and the more intense excitation of the rare earth metal halides, the red component in the spectrum of the discharge is intensified so that, with the roughened or frosted arc tube of the present invention, the desired reduction of the color temperature of the discharge results. The luminous flux decrease caused by absorption of light within the frosting is compensated by the above-described increase in luminous efficacy of the discharge. Halogen-metal vapor discharge lamps are exemplified by those disclosed in U.S. Pat. Nos. 3,452,238 and 3,842,301.

DETAILED DESCRIPTION OF ILLUSTRATED EMBODIMENTS

Figure 1:
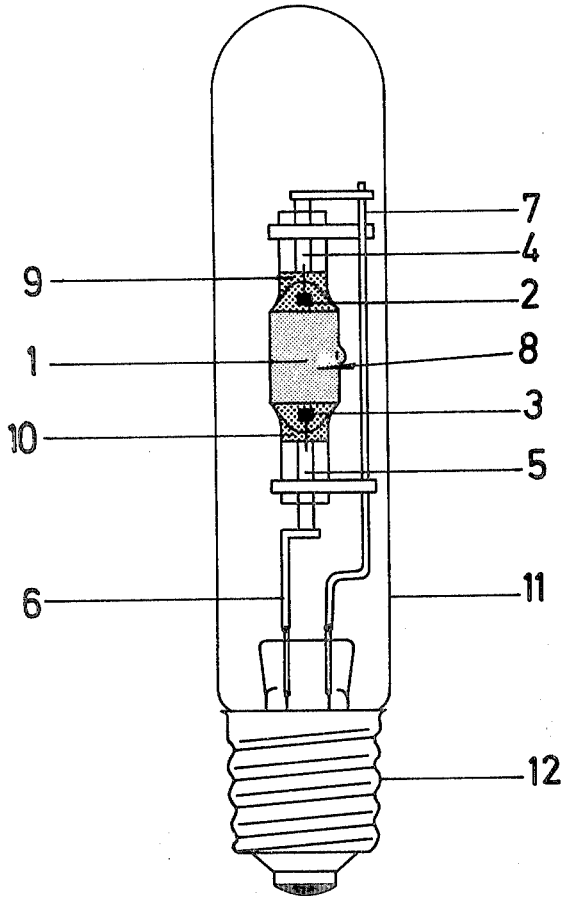
FIG. 1 is a schematic view of one embodiment of a lamp in accordance with the present invention.

In FIG. 1, the arc tube 1 of quartz glass is provided at each end thereof with a $ThO_2$-activated tungsten electrode 2 or 3, respectively, which are connected across foils 4 and 5 with the lead-in wires 6 and 7. The two foils 4 and 5 are hermetically pinch sealed in known manner in the respective end portion of arc tube 1. In the illustrated embodiment, the arc tube 1 has an inner diameter of 15.5 mm, the spacing between electrodes 2 and 3 is 27 mm and the volume is about 6 cc. The outer surface of arc tube 1 is provided with a surface which has energy absorbent, yet light transmissive characteristics, that is with a frosting 8. Each of the end portions of the arc tube is provided with a heat accumulating coating 9, 10 of $ZrO_2$. The arc tube 1 is filled with about 10 mg of mercury, 1 mg of rare earth metal, preferably dysprosium, 4 mg of $HgI_2$, 1 mg of thallium iodide, 1 mg of cesium iodide, and argon of 30 torr as the basic gas, these materials forming a preferred mix for the fill. The arc tube 1 is enclosed within an evacuated outer envelope or bulb 11 generally in tubular or ellipsoidal bulb form or, alternately, as a reflector bulb. The outer bulb 11 is provided with a screw type base 12 and may also be frosted. This is particularly useful when the outer bulb is closely fitted around the arc tube. The lamp is operated at 3 amperes (A) with an operating voltage of 100 volts (V) and a power input of 250 watts (W). With arc tube bulbs being frosted in accordance with the present invention, the luminous efficacy is 80 lm/W, the color temperature is 4600 K, and the color rendering index $R_a=90$. In comparison, a lamp having a clear arc tube bulb has a luminous efficacy of 80 lm/W, a color temperature of 5600 K, and a color rendering index $R_a=85$.

Figure 2:
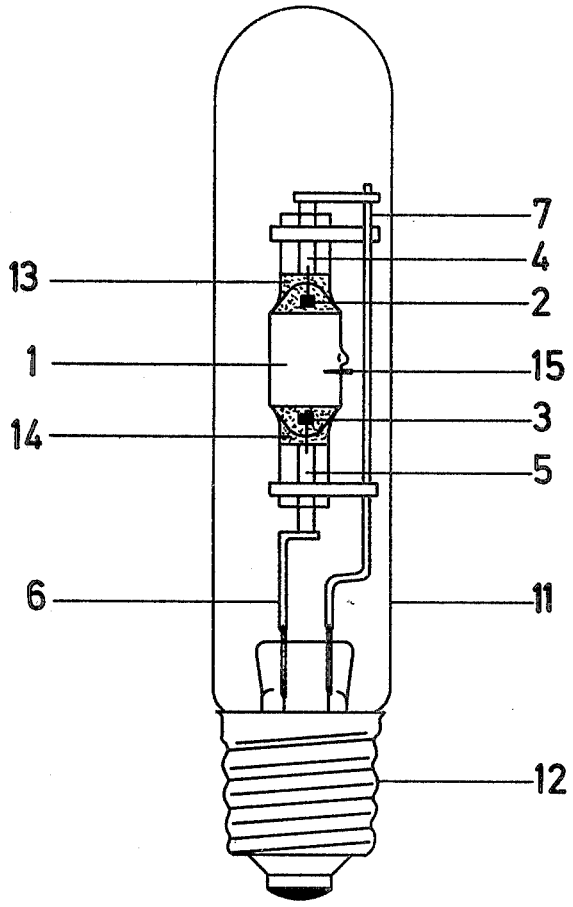
FIG. 2 is a schematic view of another embodiment.

FIG. 2 depicts a similar lamp except that only the cooler portions 13, 14 of the light transmissive outer surface are frosted, whereas the hotter portion 15 is not frosted, i.e., it is clear.

The roughening of the surface of the arc tube does not merely effect dispersion of the light derived from the arc in order to provide an optically wide light output lobe. Rather, the arc tube is roughened or matted in order to affect the energy level of, and hence the temperature of the arc tube, so that the operating conditions within the arc tube themselves will change. This results in a higher light output of the discharge than with a clear glass—contrary to expectation since, ordinarily, roughening or matting the surface decreases light—and a better color rendition. The roughening of the tube surrounding the arc cooperates with the saturation or almost saturation condition of the halogen metal vapor which, preferably, additionally contains rare earths. This requires a fill quantity which is in excess of that used with arc tubes which are clear. The excess fill quantity permits this operation at higher temperature, and hence at higher pressure, by providing sufficient fill quantity. This increase in temperature, and hence pressure, results in an increase in particles which enter the fill sump due to the increased vaporization rate, hence resulting in increased light output which balances or even more than balances the light output otherwise decreased due to the roughening or matting of the arc tube. Combined with this increase in light output is a lowering of the color temperature since a greater proportion of the rare earth halogenides will vaporize. These rare earth halides provide the portion of the lower wave length light, that is, the contribution of reddish light to the overall output. The light derived from the lamp, thus, will be equivalent to that of the black body radiator of lower color temperature, resulting, overall, in a more pleasing light output.

The arc tube or the outer tube, or both, can be roughened or matted. Matting the outer tube or surrounding housing, however, is suitable only if the distance between the outer housing or envelope and the arc tube is so small that the outer housing will become heated due to the effects of the discharge with respect to the energy absorbent surface characteristics of the housing, as described above in connection with the arc tube.

The quantity and nature of the metal halides forming the fill determine to some extent the degree of light output and whether, in comparison with a lamp having a clear arc tube, there is merely compensation of loss of light due to frosting, or even an increased light output. Of course, the color temperature of the light output will always be improved, or lowered, in comparison to a lamp having a clear glass bulb or housing. Using, for example, dysprosium as an additive, compensation of loss of light due to matting is effectively obtained. Adding a mixture of thulium, holmium and dysprosium as rare earth metals even results in an increase in light output over a lamp of otherwise similar characteristics but having a clear bulb. An excess of rare earth halides—with respect to a similar lamp having a clear bulb—must be present since the rare earth halogen is substantially vaporized to essential saturation due to the roughening of the discharge vessel, and the additional vaporization must be permitted to provide for operation of the lamp under saturated, or at least almost saturated condition. In a preferred form, the quantity of fill is such that the vapor, in operation, is saturated. Practically, a slight excess of fill is desirable so that some of the fill material may remain in unvaporized condition, to ensure that the lamp will always operate under saturation. Saturated operation is not absolutely required, although operation under saturated or almost saturated condition results in obtaining the highest light output at most desirable color temperature.

Briefly, the lamp with the entirely or partially frosted bulb must contain at least a metal halide and it may, and preferably but not necessarily, additionally contain rare earth halides. The metal halide must be present in such quantity that, in operation, it is partially or entirely vaporized. The rare earth halide should be present in such quantity that the increased temperature, due to heating of the bulb, permits additional vaporization of the rare earth halide. The type of rare earth halide will have an effect on color temperature and light output; its selection will be based on desired characteristics, including availability and price, dysprosium being preferred, and a mixture of thulium, holmium and dysprosium providing increased light output. A preferred fill includes mercury, a rare earth halide in a quantity so that, in operation, it is partially not vaporized, thallium halide, and cesium iodide for stabilization.

We claim:

1. A halogen-metal vapor discharge lamp having a good color rendition including low color temperature with good luminous efficacy comprising an evacuated light transmissive envelope surrounding a light transmissive arc tube, said arc tube enclosing a pair of electrodes and containing a fill material wherein, in accordance with the invention, (a) said fill material comprises metal halides and at least one rare earth metal halide in an amount sufficient to provide an essentially saturated vapor fill during operation of the lamp; and (b) at least portions of said light transmissive tube which, in operation of the lamp, are cooler than other portions of said tube are formed with, light energy absorbent surface characteristics and comprising portions which are roughened or frosted, to cause, during operation of said lamp due to absorption of light energy by said frosted portions an increase in the temperature of said portions and a consequent rise in vapor pressure in the lamp and rise in the temperature of the metal halide—rare earth halide fill material to a higher temperature resulting in an increase vapor pressure, and in light output of lower color termperature at good luminous efficacy and improved color rendition.

2. The halogen-metal vapor discharge lamp of claim 1, wherein said fill includes mercury, and wherein said halogen is selected from the group consisting of iodine and bromine.

3. The halogen-metal vapor discharge lamp of claim 2, wherein said fill material contains thallium and wherein said halogen is iodine.

4. The halogen-metal vapor discharge lamp of claim 3, wherein said fill material contains dysprosium as the rare earth metal, and also contains cesium iodide.

5. The halogen-metal vapor discharge lamp of claim 1, wherein said halogen is at least iodide.

6. The halogen-metal vapor discharge lamp of claim 2, wherein said fill material contains dysprosium as the rare earth metal.

7. The halogen-metal vapor discharge lamp of claim 1, wherein said fill material contains a mixture of thulium, holmium and dysprosium as rare earth metals.

8. The halogen-metal vapor discharge lamp of claim 1, wherein said fill material contains cesium.

9. The halogen-metal vapor discharge lamp of claim 1, wherein all of said light transmissive portion of said arc tube is frosted.

10. In a halogen-metal vapor discharge lamp comprising a light transmissive envelope surrounding a light discharge arc tube, said arc tube having a light transmissive outer surface and containing a fill material comprising a vaporizable metal halide, and a rare earth metal halide additive the improvement comprising means to increase the fill temperature and vapor pressure during lamp operation including said fill material being present in an amount sufficient to provide a saturated vapor fill during lamp operation;

and means converting a portion of the light energy to heat including at least a portion of the colder portions of said light transmissive outer surface of said arc tube being of frosted, or roughened light absorbent surface characteristic to cause absorption of light by said frosted surface portion and consequent heating thereof which, during lamp operation, increases the fill temperature and vapor pressure to produce a transmitted light having a low color temperature, good color rendition and good luminous efficacy.

11. The halogen-metal vapor discharge lamp of claim 10 wherein said fill includes mercury, and wherein said halogen is selected from the group consisting of iodine and bromine.

12. The halogen-metal vapor discharge lamp of claim 11 wherein said fill material contains cesium iodide and dysprosium halide.

13. The halogen-metal vapor discharge lamp of claim 10 wherein said fill material contains thallium and wherein said halogen includes iodine.

14. The halogen-metal vapor discharge lamp of claim 13 wherein said fill material also contains cesium iodide.

15. The halogen-metal vapor discharge lamp of claim 14 wherein all of said light transmissive portion of said arc tube is frosted.

16. The halogen-metal vapor discharge lamp of claim 14 wherein said rare-earth metal includes dysprosium halide.

17. The halogen-metal vapor discharge lamp of claim 10 wherein all of said light transmissive portion of said arc tube is frosted.

18. The halogen-metal vapor discharge lamp of claim 17 wherein said fill material contains cesium iodide and dysprosium halide.

19. The halogen-metal vapor discharge lamp of claim 10, wherein said fill material contains dysprosium.

20. The halogen-metal vapor discharge lamp of claim 10, wherein said fill material contains a mixture of thulium, holmium and dysprosium.

21. The halogen-metal vapor discharge lamp of claim 10, further including a light transmissive envelope (11) located close to the arc tube (1) and at a distance from the arc tube, sufficiently small to be impinged by radiation from excited fill material to raise the temperature thereof, in operation of the lamp, by absorption of energy derived from the excited fill.

22. The halogen-metal vapor discharge lamp of claim 21, wherein said light transmissive envelope is frosted.

23. The halogen vapor discharge lamp of claim 2 wherein said fill material contains dysprosium as the rare earth metal, and also contains cesium iodide.

* * * * *

UNITED STATES PATENT AND TRADEMARK OFFICE

CERTIFICATE OF CORRECTION

PATENT NO. : 4,249,102

DATED : February 3, 1981

INVENTOR(S) : Rudolf KRIEG et al

It is certified that error appears in the above-identified patent and that said Letters Patent are hereby corrected as shown below:

Claim 6, lines 1 and 2 (column 4, line 66, 67) change "claim 2" to -- claim 1 --

Signed and Sealed this

*Eighth* Day of *September 1981*

[SEAL]

*Attest:*

GERALD J. MOSSINGHOFF

*Attesting Officer*

*Commissioner of Patents and Trademarks*